US010927635B2

(12) United States Patent
Kelbie et al.

(10) Patent No.: US 10,927,635 B2
(45) Date of Patent: Feb. 23, 2021

(54) PUMP DOWN ISOLATION PLUG

(71) Applicants: Graeme Michael Kelbie, Cypress, TX (US); Kent S. Meyer, Tomball, TX (US)

(72) Inventors: Graeme Michael Kelbie, Cypress, TX (US); Kent S. Meyer, Tomball, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 247 days.

(21) Appl. No.: 15/728,664

(22) Filed: Oct. 10, 2017

(65) Prior Publication Data

US 2019/0106960 A1 Apr. 11, 2019

(51) Int. Cl.
*E21B 33/127* (2006.01)
*E21B 37/02* (2006.01)
*E21B 23/08* (2006.01)

(52) U.S. Cl.
CPC ..... *E21B 33/127* (2013.01); *E21B 23/08* (2013.01); *E21B 37/02* (2013.01)

(58) Field of Classification Search
CPC ..... E21B 33/127–1277; E21B 33/1295
See application file for complete search history.

(56) References Cited

U.S. PATENT DOCUMENTS 2,870,843 A * 1/1959 Rodgers, Jr. ..... E21B 34/08 166/115
3,139,140 A * 6/1964 Brown ..... E21B 33/12955 166/120
3,303,884 A * 2/1967 Medford, Jr. ..... E21B 23/065 166/122
3,448,611 A * 6/1969 Lebourg ..... E21B 49/081 73/152.28
4,869,324 A 9/1989 Holder
4,886,113 A * 12/1989 Ross ..... E21B 17/06 166/51
5,664,629 A * 9/1997 Maitland ..... E21B 34/102 166/373
5,697,442 A * 12/1997 Baldridge ..... E21B 17/10 166/177.4
5,829,526 A * 11/1998 Rogers ..... E21B 21/10 166/291

(Continued)

FOREIGN PATENT DOCUMENTS

GB 2505165 A 2/2014
WO WO2017081494 A1 5/2017

OTHER PUBLICATIONS

International Search Report and Written Opinion for International Application No. PCT/US2018/049498; International Filing Date Sep. 5, 2018; Report dated Jan. 2, 2019 (pp. 1-10).

(Continued)

*Primary Examiner* — Steven A MacDonald
(74) *Attorney, Agent, or Firm* — Cantor Colburn LLP

(57) ABSTRACT

An isolation plug including a support element having a first end, a second end, and an intermediate portion extending therebetween. At least one flexible wiper element is arranged at the first end. A frangible locator element is arranged at the first end spaced from the at least one flexible wiper element. A selectively deployable plug element is arranged at the second end.

15 Claims, 4 Drawing Sheets

(56) References Cited

U.S. PATENT DOCUMENTS 6,050,336 A * 4/2000 Willauer ..... E21B 23/06 166/286
6,056,053 A * 5/2000 Giroux ..... E21B 21/10 166/155
6,145,595 A * 11/2000 Burris, II ..... E21B 34/108 166/374
10,167,699 B2 * 1/2019 Harestad ..... E21B 23/10
10,465,476 B2 * 11/2019 Murray ..... E21B 23/06
2003/0062161 A1 * 4/2003 Mondelli ..... E21B 21/10 166/291
2005/0115720 A1 * 6/2005 MacKenzie ..... E21B 23/06 166/387
2007/0119600 A1 * 5/2007 Slup ..... E21B 33/134 166/387
2009/0183875 A1 7/2009 Rayssiguier et al.
2009/0250227 A1 * 10/2009 Brown ..... E21B 33/10 166/386
2010/0230116 A1 * 9/2010 Harmon ..... E21B 47/09 166/382
2011/0017472 A1 1/2011 Maxwell
2012/0168178 A1 * 7/2012 Eriksen ..... E21B 23/04 166/382
2012/0305265 A1 * 12/2012 Garcia ..... E21B 34/14 166/373
2013/0105158 A1 5/2013 Saltel
2013/0175035 A1 * 7/2013 Lee ..... E21B 33/12 166/298
2014/0238694 A1 * 8/2014 Fraser ..... E21B 23/06 166/382
2016/0040485 A1 * 2/2016 Bishop ..... E21B 40/00 166/381
2016/0084040 A1 * 3/2016 Brasseaux ..... E21B 34/14 166/374
2016/0251938 A1 * 9/2016 Murray ..... E21B 34/10 166/387
2016/0305220 A1 * 10/2016 Fraser ..... B08B 9/055
2018/0112488 A1 * 4/2018 Budde ..... E21B 33/1208
2019/0078408 A1 * 3/2019 Fripp ..... E21B 43/26

OTHER PUBLICATIONS

CX Technologies "Wellbore Clean Up Tools & Solutions" Retrieved Apr. 18, 2019; 13 pages.

* cited by examiner

PUMP DOWN ISOLATION PLUG

BACKGROUND

In the drilling and completion industry, it is often desirable to close off a well bore for a period of time. For example, it is desirable to close a wellbore prior to abandonment. To close a wellbore, one or more plugs are inserted to a desired depth(s). After inserting the plugs, cement or other filler material may be introduced into the well bore. If it is desirable to reopen the wellbore, the cement and plug(s) may be removed by, for example, drilling. A plug may be run through a system of tubulars to a desired position in the wellbore. The plug is typically connected to connect to a deployment string and introduced into the wellbore. The deployment string could take the form of coil tubing, wireline, or slickline tools.

Running a deployment tool into a wellbore is a time consuming labor intensive process, as it the removal of the deployment tool after plug installation. Further, if setting multiple plugs, the deployment tool must be run in and removed multiple times. Accordingly, the art would be receptive to a system of installing and setting plugs that did not require a deployment tool.

SUMMARY

Disclosed is an isolation plug including a support element having a first end, a second end, and an intermediate portion extending therebetween. At least one flexible wiper element is arranged at the first end. A frangible locator element is arranged at the first end spaced from the at least one flexible wiper element. A selectively deployable plug element is arranged at the second end.

Also disclosed is a resource exploration and recovery system includes a first system and a second system fluidically connected to the first system. The second system includes a string of tubulars. At least one of the string of tubulars includes a locator grapple. An isolation plug is selectively arranged within the string of tubulars. The isolation plug includes a support element having a first end, a second end, and an intermediate portion extending therebetween. At least one flexible wiper element is arranged at the first end. A frangible locator element is arranged at the first end spaced from the at least one flexible wiper element. The frangible locator element is selectively engaged with the locator grapple. A selectively deployable plug element is arranged at the second end.

Further disclosed is a method of plugging a wellbore includes pumping an isolation plug along a string of tubulars, engaging a frangible locator element on the isolation plug with a locator grapple arranged on the string of tubulars, expanding a plug portion of the isolation plug, and detaching the frangible locator element from the locator grapple.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
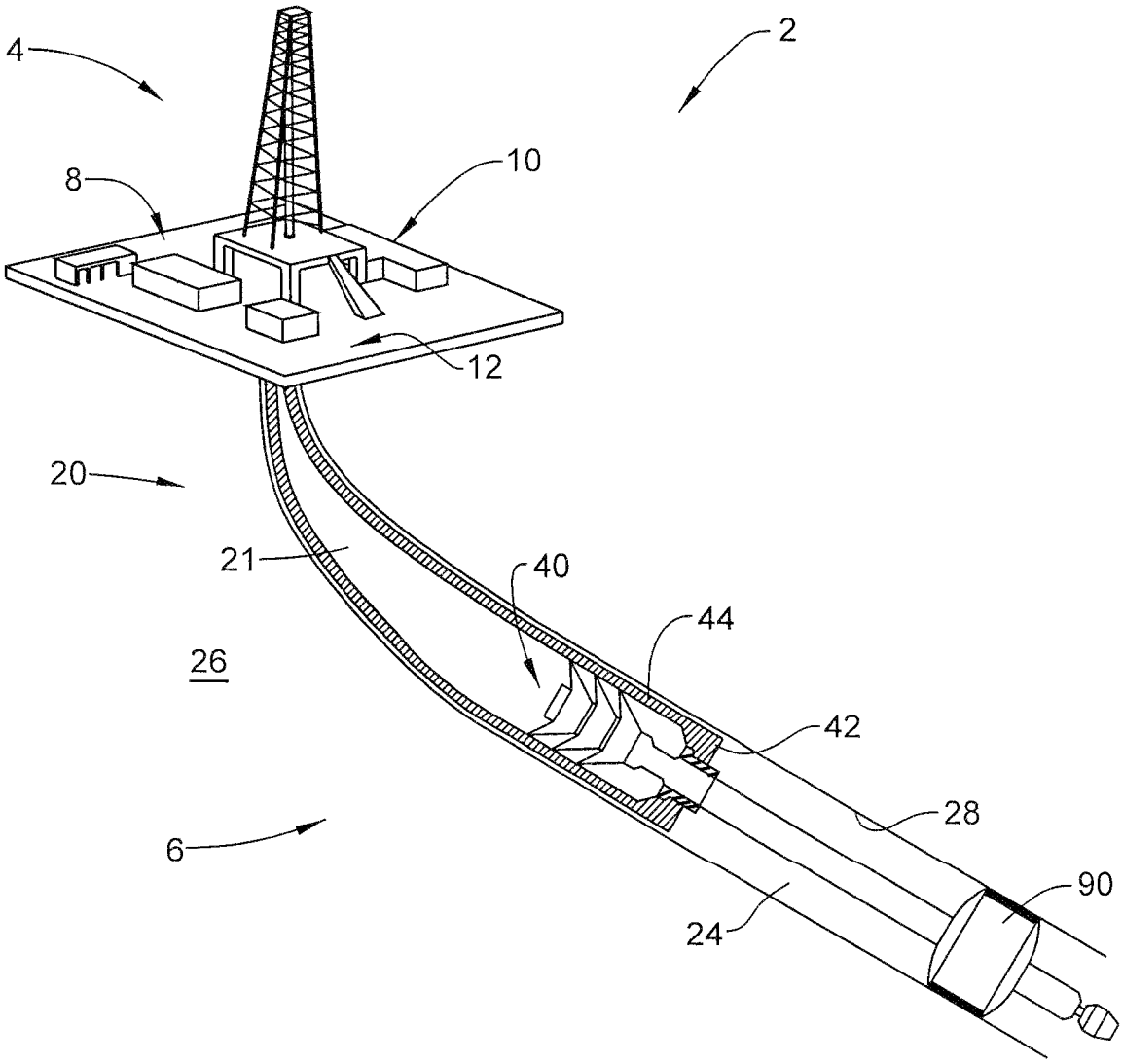
FIG. 1 depicts a resource exploration and recovery system including an isolation plug, in accordance with an aspect of an exemplary embodiment.

A resource exploration and recovery system, in accordance with an exemplary embodiment, is indicated generally at 2, in FIG. 1. Resource exploration and recovery system 2 should be understood to include well drilling operations, resource extraction and recovery, $CO_2$ sequestration, and the like. Resource exploration and recovery system 2 may include a first system 4 which, in some environments, may take the form of a surface system operatively and fluidically connected to a second system 6 which, in some environments, may take the form of a downhole system. First system 4 may include pumps 8 that aid in completion and/or extraction processes as well as fluid storage 10. Fluid storage 10 may contain a stimulation fluid which may be introduced into downhole system 6. First system 4 may also include a control system 12 that may monitor and/or activate one or more downhole operations.

Second system 6 may include a tubular string 20 formed from a plurality of tubulars, one of which is indicated at 21 that is extended into a wellbore 24 formed in formation 26. Wellbore 24 includes an annular wall 28. An isolation plug 40 may be pumped down tubular string 20. Isolation plug 40 may be landed at a locating grapple 42 arranged at a terminal tubular 44 of plurality of tubulars 20. As will be detailed herein, isolation plug 40 may be activated to seal against annular wall 28 isolating one portion of wellbore 24 from another.

Referring to FIGS. 2-5 and with continued reference to FIG. 1, isolation plug 40 includes a support element 50 having a first end 56, a second end 57 and an intermediate portion 58 extending therebetween. A passage 60 extends through support element 50 from first end 56 through second end 57. Passage 60 may support a valve 64 and a baffle element 67. A wiper dart 74 is arranged at first end 56. Wiper dart 74 includes one or more flexible wiper elements 77 that engage with an inner wall (not separately labeled) of tubulars 21. Wiper elements 77 form a seal that promotes pumping isolation plug 40 towards terminal tubular 44.

Figure 3:
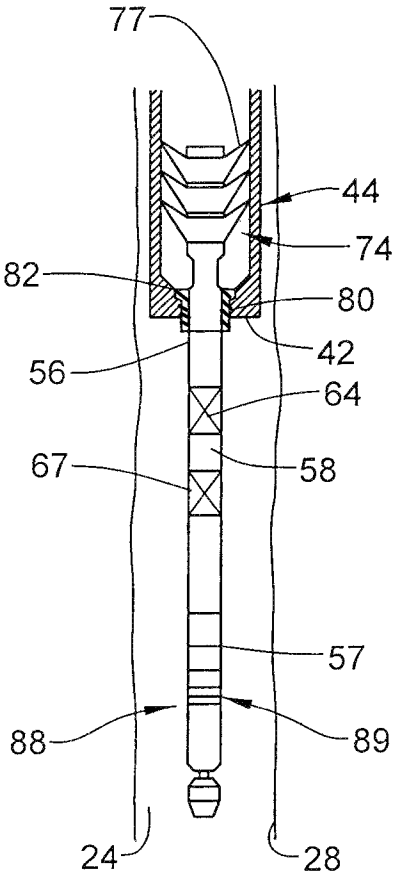
FIG. 3 depicts the isolation plug landing at a locating grapple on one tubular of the tubular string of FIG. 2, in accordance with an aspect of an exemplary embodiment.
Figure 2:
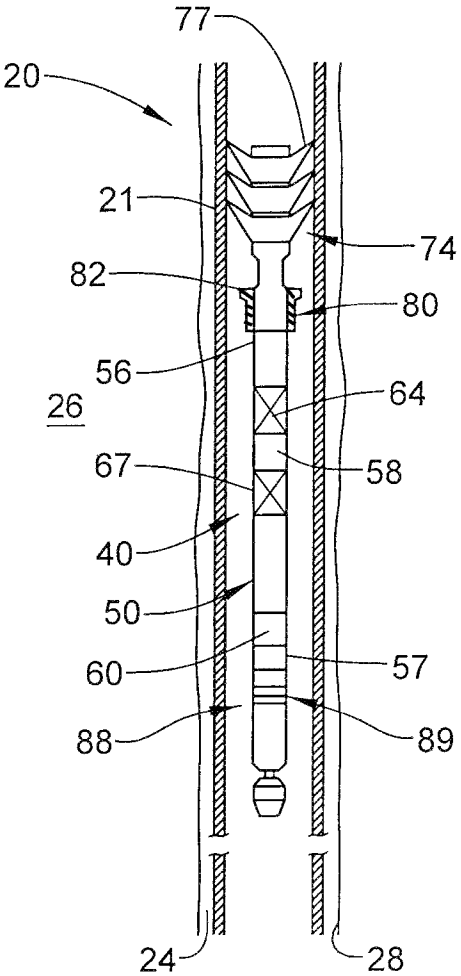
FIG. 2 depicts the isolation plug arranged in a tubular string of the resource exploration and recovery system, in accordance with an aspect of an exemplary embodiment.

In accordance with an exemplary aspect, isolation plug 40 also includes a frangible locator element 80 arranged at first end 56. Frangible locator element 80 includes a lip 82 that selectively engages with locating grapple 42 to position isolation plug 40 at a selected position in wellbore 24 as shown in FIG. 3. Isolation plug 40 is further shown to include a selectively deployable plug element 88 having a flexible plug member 89 including an outer surface 90 that is selectively urged against annular wall 28 of wellbore 24. Flexible plug member may be formed from a variety of elastomeric materials. Flexible plug member 89 may also include swellable components (not separately labeled) that promote additional expansion of selectively deployable plug element 88.

Figure 4:
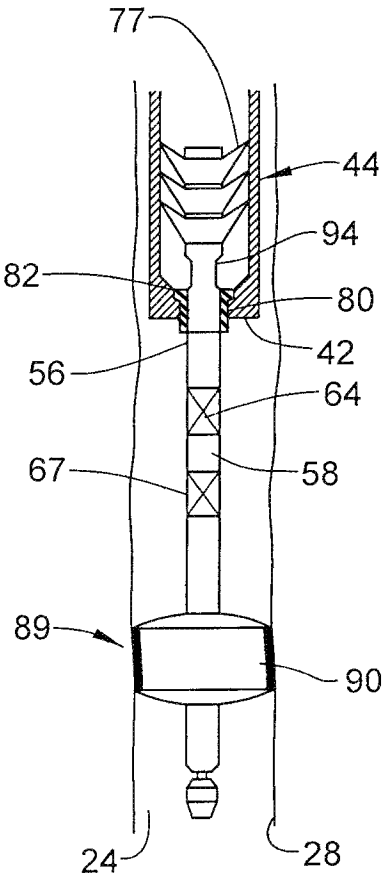
FIG. 4 depicts the isolation plug of FIG. 3 being expanded, in accordance with an aspect of an exemplary embodiment.

In further accordance with an exemplary aspect, a fluid may be introduced into tubulars 21 and pumped down to isolation plug 40. The fluid may enter first end 56 of support element 50 and flow into passage 60. Valve 64 may be opened to allow the fluid to pass through baffle element 67. Baffle element 67 controls a flow rate of the fluid passing towards selectively deployable plug element 88. The fluid inflates or expands selectively deployable plug element 88 toward annular wall 28 as shown in FIG. 4.

Figure 5:
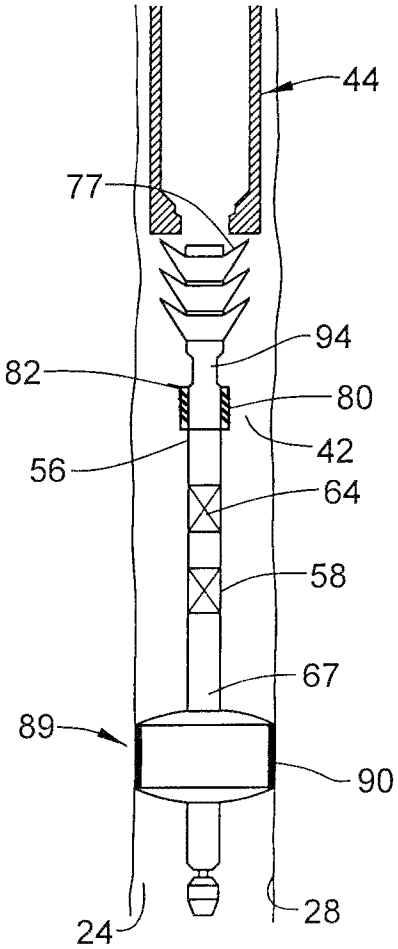
FIG. 5 depicts the tubular string detaching from the isolation plug of FIG. 4, in accordance with an aspect of an exemplary embodiment.

When a selected seal has been established between outer surface 90 and annular wall 28, valve 64 may be closed and tubular string 20 shifted, causing frangible locator element 80 to disengage from locating grapple 42 as shown in FIG. 5. For example, frangible locator element 80 may radially compress into a recess 94 or lip 82 may disengage or fail. At this point, tubular string 20 may be repositioned and another isolation plug (not shown) installed, or cement may be introduced into wellbore 24 and tubular string 20 may be removed.

Figure 7:
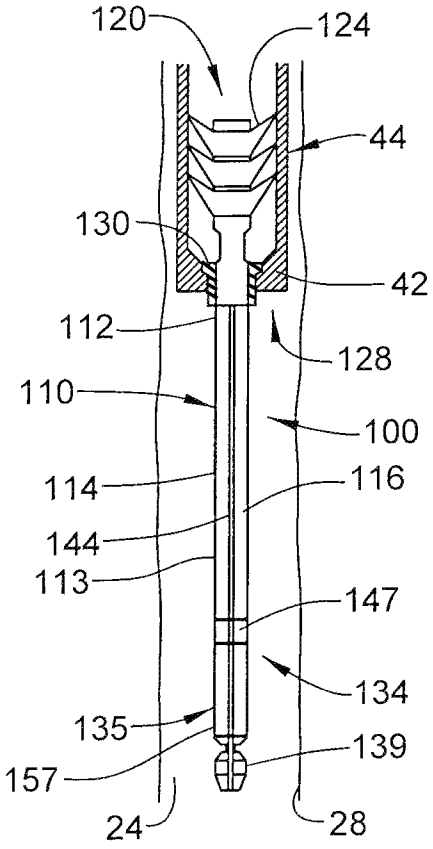
FIG. 7 depicts the isolation plug of FIG. 6 landing at the locating grapple, in accordance with an aspect of an exemplary embodiment.
Figure 6:
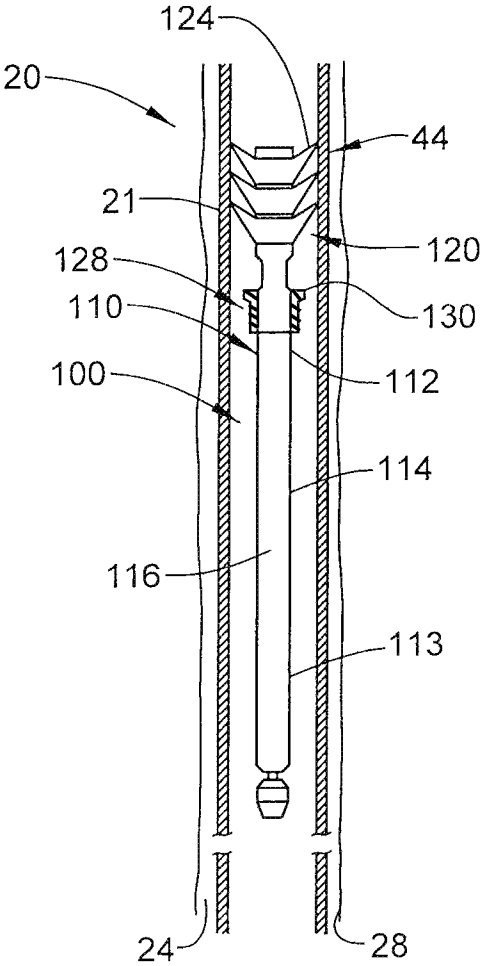
FIG. 6 depicts an isolation plug arranged in a tubular string of the resource exploration and recovery system, in accordance with another aspect of an exemplary embodiment.

Reference will now follow to FIGS. 6-7 in describing an isolation plug 100 in accordance with an exemplary embodiment. Isolation plug 40 includes a support element 110 having a first end 112, a second end 113 and an intermediate portion 114 extending therebetween. A passage 116 extends through support element 110 from first end 112 through second end 113. A wiper dart 120 is arranged at first end 112. Wiper dart 120 includes one or more flexible wiper elements 124 that engage with an inner wall (not separately labeled) of tubulars 21. Flexible wiper elements 124 form a seal that promotes pumping isolation plug 100 towards terminal tubular 44.

In accordance with an exemplary aspect, isolation plug 100 also includes a frangible locator element 128 arranged at first end 112. Frangible locator element 128 includes a lip 130 that selectively engages with locating grapple 42 to position isolation plug 100 at a selected position in wellbore 24 as shown in FIG. 7. Isolation plug 100 is further shown to include a selectively deployable plug element 134 having a flexible plug member 135 including an outer surface 137 that is selectively urged against annular wall 28 of wellbore 24 and a terminal end 139. Flexible plug member 135 may be formed from a variety of elastomeric materials. Flexible plug member 135 may also include swellable components (not separately labeled) that promote additional expansion of selectively deployable plug element 134.

Figure 8:
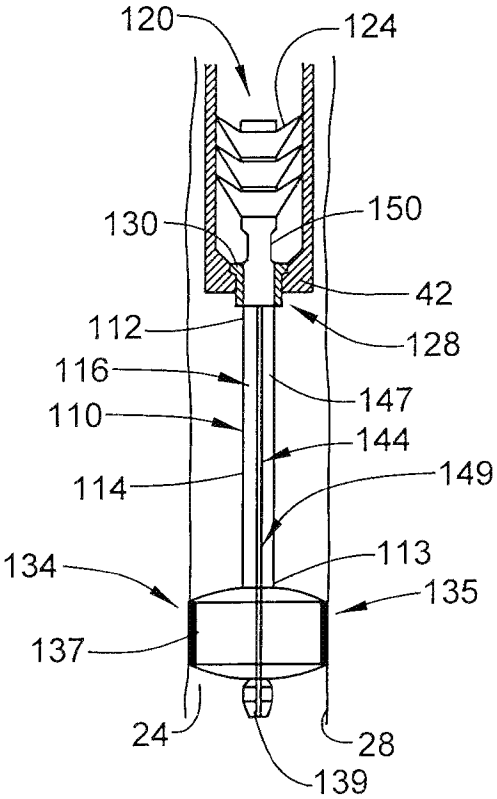
FIG. 8 depicts the isolation plug of FIG. 6 being expanded, in accordance with an aspect of an exemplary embodiment.

In further accordance with an exemplary aspect, an actuation rod 144 extends through passage 116 and connects with terminal end 139 of flexible plug member 135. Actuation rod 144 supports a piston 147 that defines a chamber 149. Chamber 149 exists between piston 147 and second end 113. In this manner, a fluid may be introduced into tubulars 21 and pumped down to isolation plug 100. The fluid may enter first end 112 of support element 110 and flow into passage 116. The fluid may then pass into chamber 149. Fluid pressure may be increased causing piston 147 to transition from second end 113 toward first end 112 as shown in FIG. 8. The movement of piston 147 causes actuation rod 144 to act upon or contract terminal end 139 towards second end 113. The movement of actuation rod 144 deploys flexible plug element 135.

Figure 9:
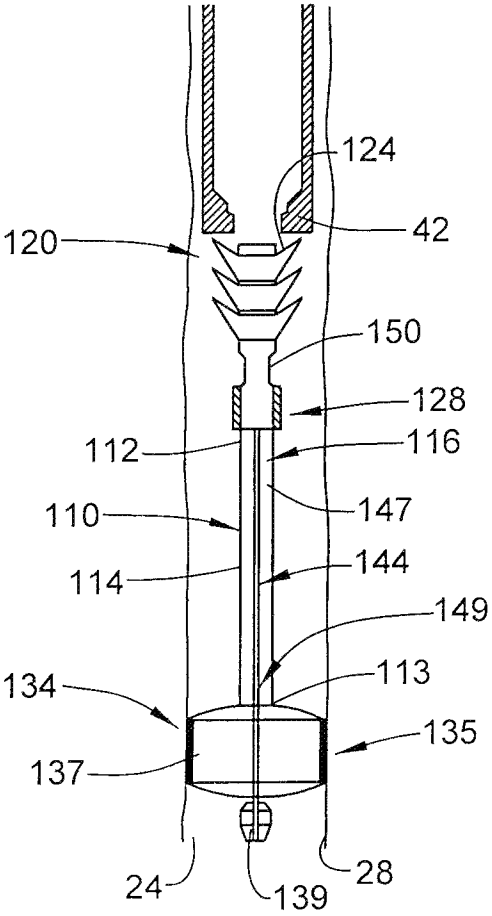
FIG. 9 depicts the tubular string detaching from the isolation plug of FIG. 8, in accordance with an aspect of an exemplary embodiment.

When a selected seal has been established between outer surface 137 and annular wall 28, tubular string 20 shifts, causing frangible locator element 128 to disengage from locating grapple 42 as shown in FIG. 9. For example, frangible locator element 128 may radially compress into a recess 150, or lip 130 may disengage or fail. At this point, tubular string 20 may be repositioned and another isolation plug (not shown) installed, or cement may be introduced into wellbore 24 and tubular string 20 may be removed. Thus, it should be understood that the exemplary embodiments describe an isolation plug that may be introduced into a wellbore through existing tubulars, positioned, activated and left in place without the need for additional tooling. The isolation plug may be installed prior to abandonment of the wellbore. For example, the isolation plug may be installed through an existing completion string or may be installed after removal of a completion. Further, it should be understood that the isolation plug may be employed as a zonal isolation device or for other purposes when it may be desirable to close off all or a portion of a wellbore for a period of time.

Set forth below are some embodiments of the foregoing disclosure:

Embodiment 1: An isolation plug comprising a support element including a first end, a second end, and an intermediate portion extending therebetween, at least one flexible wiper element arranged at the first end, a frangible locator element arranged at the first end spaced from the at least one flexible wiper element; and a selectively deployable plug element arranged at the second end.

Embodiment 2: The isolation plug according to any prior embodiment, wherein the support element includes a passage extending from the first end toward the second end, the selectively deployable plug element being selectively expanded by a fluid pumped into the passage.

Embodiment 3: The isolation plug according to any prior embodiment, further comprising a valve arranged in the support element, the valve controlling a fluid flow into the selectively deployable plug element.

Embodiment 4: The isolation plug according to any prior embodiment, further comprising a baffle element arranged in the support element, the baffle element controlling a flow rate of fluid into the selectively deployable plug element.

Embodiment 5: The isolation plug according to any prior embodiment, further comprising an actuation rod extending through the support element and connecting with the selectively deployable plug element.

Embodiment 6: The isolation plug according to any prior embodiment, further comprising a piston mechanically connected with the actuation rod.

Embodiment 7: A resource exploration and recovery system comprising a first system, a second system fluidically connected to the first system, the second system including a string of tubulars, at least one of the string of tubulars including a locator grapple, and an isolation plug selectively arranged within the string of tubulars, the isolation plug comprising a support element including a first end, a second end, and an intermediate portion extending therebetween, at least one flexible wiper element arranged at the first end, a frangible locator element arranged at the first end spaced from the at least one flexible wiper element, the frangible locator element being selectively engaged with the locator grapple, and a selectively deployable plug element arranged at the second end.

Embodiment 8: The resource exploration and recovery system according to any prior embodiment, wherein the support element includes a passage extending from the first end toward the second end, the selectively deployable plug element being selectively expanded by a fluid pumped into the passage.

Embodiment 9: The resource exploration and recovery system according to any prior embodiment, further comprising a valve arranged in the support element, the valve controlling a fluid flow into the selectively deployable plug element.

Embodiment 10: The resource exploration and recovery system according to any prior embodiment, further comprising a baffle element arranged in the support element, the baffle element controlling a flow rate of fluid into the selectively deployable plug element.

Embodiment 11: The resource exploration and recovery system according to any prior embodiment, further comprising an actuation rod extending through the support element and connecting with the selectively deployable plug element.

Embodiment 12: The resource exploration and recovery system according to any prior embodiment, further comprising a piston mechanically connected with the actuation rod.

Embodiment 13: A method of plugging a wellbore comprising pumping an isolation plug along a string of tubulars, engaging a frangible locator element on the isolation plug with a locator grapple arranged on the string of tubulars, expanding a plug portion of the isolation plug, and detaching the frangible locator element from the locator grapple.

Embodiment 14: The method of any prior embodiment, wherein expanding the plug portion includes directing a flow of fluid into the plug portion.

Embodiment 15: The method of any prior embodiment, wherein expanding the plug portion includes drawing a portion of the plug portion toward the frangible locator.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An isolation plug comprising:

a support element including a first end, a second end, and an intermediate portion extending therebetween;

at least one flexible wiper element extending axially off of the first end;

a frangible locator element arranged on the support element at the first end adjacent to the at least one flexible wiper element, the frangible locator element being a one-piece component including a frangible lip; and a selectively deployable plug element arranged at the second end.

2. The isolation plug according to claim 1, wherein the support element includes a passage extending from the first end toward the second end, the selectively deployable plug element being selectively expanded by a fluid pumped into the passage.

3. The isolation plug according to claim 2, further comprising: a valve arranged in the support element, the valve controlling a fluid flow into the selectively deployable plug element.

4. The isolation plug according to claim 3, further comprising: a baffle element arranged in the support element, the baffle element controlling a flow rate of fluid into the selectively deployable plug element.

5. The isolation plug according to claim 1, further comprising an actuation rod extending through the support element and connecting with the selectively deployable plug element.

6. The isolation plug according to claim 5, further comprising: a piston mechanically connected with the actuation rod.

7. A resource exploration and recovery system comprising:

a first system;

a second system fluidically connected to the first system, the second system including a string of tubulars, at least one of the string of tubulars including a locator grapple; and an isolation plug selectively arranged within the string of tubulars, the isolation plug comprising:

a support element including a first end, a second end, and an intermediate portion extending therebetween;

at least one flexible wiper element extending axially off of the first end;

a frangible locator element arranged on the support element at the first end adjacent to the at least one flexible wiper element, the frangible locator element being a one-piece component including a frangible lip that is selectively engaged with the locator grapple; and a selectively deployable plug element arranged at the second end.

8. The resource exploration and recovery system according to claim 7, wherein the support element includes a passage extending from the first end toward the second end, the selectively deployable plug element being selectively expanded by a fluid pumped into the passage.

9. The resource exploration and recovery system according to claim 8, further comprising: a valve arranged in the support element, the valve controlling a fluid flow into the selectively deployable plug element.

10. The resource exploration and recovery system according to claim 9, further comprising: a baffle element arranged in the support element, the baffle element controlling a flow rate of fluid into the selectively deployable plug element.

11. The resource exploration and recovery system according to claim 7, further comprising an actuation rod extending through the support element and connecting with the selectively deployable plug element.

12. The resource exploration and recovery system according to claim 11, further comprising: a piston mechanically connected with the actuation rod.

13. A method of plugging a wellbore comprising:

pumping an isolation plug including a support element having a first end and an opposing second end along a string of tubulars by engaging at least one flexible wiper arranged at the first end with a fluid;

engaging a one-piece frangible locator element including a frangible lip arranged at the first end adjacent to the least one flexible wiper with a locator grapple arranged on the string of tubulars;

expanding a plug portion of the isolation plug arranged at the opposing second end of the support element; and shifting the string of tubulars causing the frangible lip to fail thereby detaching the isolation plug from the locator grapple.

14. The method of claim 13, wherein expanding the plug portion includes directing a flow of fluid into the plug portion.

15. The method of claim 13, wherein expanding the plug portion includes drawing a portion of the plug portion toward the frangible locator element.

* * * * *